US006811810B2

(12) United States Patent
LaFay et al.

(10) Patent No.: US 6,811,810 B2
(45) Date of Patent: Nov. 2, 2004

(54) CONCRETE FORM RELEASE COMPOSITIONS

(75) Inventors: Victor Steven LaFay, Cincinnati, OH (US); Stephen Louis Neltner, Alexandria, KY (US)

(73) Assignee: The Hill and Griffith Company, Cincinnati, OH (US)

( * ) Notice: Subject to any disclaimer, the term of this patent is extended or adjusted under 35 U.S.C. 154(b) by 243 days.

(21) Appl. No.: 10/071,891

(22) Filed: Feb. 7, 2002

(65) Prior Publication Data

US 2002/0172759 A1 Nov. 21, 2002

Related U.S. Application Data

(60) Provisional application No. 60/267,060, filed on Feb. 7, 2001.

(51) Int. Cl.[7] ..... B05D 3/00; B05D 5/08
(52) U.S. Cl. ..... 427/133; 427/135
(58) Field of Search ..... 427/133, 135

(56) References Cited

U.S. PATENT DOCUMENTS

| | | | | |
|---|---|---|---|---|
| 3,424,607 A | * | 1/1969 | Coscia | 427/133 |
| 4,740,324 A | | 4/1988 | Schur | |
| 5,100,697 A | * | 3/1992 | Nielsen | 427/133 |
| 5,194,584 A | | 3/1993 | Leahy | |
| 5,374,303 A | | 12/1994 | van Hoorn | |
| 5,378,270 A | | 1/1995 | Takashima | |
| 5,474,604 A | | 12/1995 | Demmering et al. | |
| 5,494,502 A | | 2/1996 | DeLong | |
| 5,605,953 A | | 2/1997 | Esser | |
| 5,626,656 A | | 5/1997 | Kondo et al. | |
| 5,647,899 A | | 7/1997 | Lightcap, Jr. | |
| 5,709,739 A | | 1/1998 | Wittich et al. | |
| 5,900,048 A | | 5/1999 | Olson et al. | |
| 5,900,456 A | | 5/1999 | Hashiuchi et al. | |
| 6,126,757 A | | 10/2000 | Kinnaird | |
| 6,326,429 B1 | | 12/2001 | Sturgis et al. | |

FOREIGN PATENT DOCUMENTS

| | | | |
|---|---|---|---|
| CN | 1129633 | * | 8/1996 |
| DE | 92990 | * | 10/1972 |
| DE | 225432 | * | 7/1985 |
| GB | 1414331 | * | 11/1975 |
| JP | 54-116018 | * | 9/1979 |
| JP | 55-065507 | * | 5/1980 |

OTHER PUBLICATIONS

F–500 *Enviro Form Release Super Concentrate,* Specco Industries, Inc. web site (Jun. 18, 2001).

* cited by examiner

*Primary Examiner*—Erma Cameron
(74) *Attorney, Agent, or Firm*—Thompson Hine LLP

(57) ABSTRACT

The forming of shapes using cement and/or concrete is an old art. In this process a form is removed, leaving the shape of the pattern which is the result of the form designed. Fluid concrete and/or cement can then be poured into the cavity to form the object. To increase the life of the forms, and to make removal of the form easier, the form must be coated with a protective material. Despite many available form release compounds, mineral seal oil, and a mixture of mineral seal and oleic acid, have been the commercial choices. A biodegradable form release composition including vegetable oil with a petroleum oil and/or an alcohol and a method of utilizing such a release composition to reduce adhesion between concrete and formwork or a mold is disclosed. The form release composition is biodegradable with a low VOC content.

21 Claims, No Drawings

CONCRETE FORM RELEASE COMPOSITIONS

CROSS-REFERENCE TO RELATED APPLICATION

This application claims priority from U.S. Provisional Application No. 60/267,060 filed Feb. 7, 2001.

BACKGROUND OF THE INVENTION

This invention pertains to the casting of cement and/or concrete objects, and particularly to methods and materials for increasing the lives of the forms which are employed therein.

The introduction of a fluid cement and or concrete into a cavity, or mold, where upon solidification, the resulting casting becomes an object whose shape was determined by the mold, is an old art. In this molding process a wood, metal or plastic form is fabricated in the shape of the part to be produced. Materials are then compacted around the form in such a way that the mold and the pattern can be removed, leaving a cast object in the shape of the form.

It is well known that to increase the life of the forms (wood, metal or plastic) and to make the removal of the casting easier, the surfaces of the mold cavity must be coated with a protective material.

Prior art coating compositions however deal primarily with film forming form release coatings made by blending of petroleum based oils with organic additives such as oleic acid, waxes, paraffin, and the like.

Coatings for the concrete and cement industry are basically form release agents. They are used to obtain smoother casting surfaces with fewer defects. The cast surfaces of the concrete and/or cement erode and pit when successive forms are produced using them. When such erosion occurs, concrete and/or cement have a greater tendency to adhere to the pattern when it is removed, affecting the cast surface. Petroleum based mineral seal oil and mineral seal oil-oleic acid form release coatings are presently the commercial preference. By contrast, the vegetable oil based form release coatings in accordance with the present invention are biodegradable and provide improved release properties and increase the number of molds/application.

SUMMARY OF THE INVENTION

The present invention relates to a method of protecting cast cement and/or concrete from eroding and pitting during casting by preventing adherence of casting surfaces using a biodegradable and low VOC (Volatile Organic Compound) form release coating applied to the form. In accordance with one aspect of the invention, the method involves applying a biodegradable vegetable oil composition to the surfaces of a form in an amount sufficient to form a coating which prevents adherence and affords the necessary protection. The coating composition in accordance with one embodiment of the present invention relates to a biodegradable blend of vegetable oil with petroleum oil and/or alcohol. In accordance with another embodiment of the present invention, the coating composition is an emulsified vegetable oil, and the clay incorporated therein is an organophilic clay, included in the coating as such or as a clay water dispersible amine mixture. The emulsion, then, is a 40/60 by weight oil emulsion.

DETAILED DESCRIPTION OF THE INVENTION

This invention relates to an improvement of the processes for coating forms with a form release coating wherein the coating composition includes a vegetable oil with petroleum oil and/or alcohol. Alternatively, the coating composition is prepared by forming an aqueous emulsion of a vegetable oil using a water dispersible amine and a clay reactive therewith as emulsifiers. It will be appreciated that the amine and the clay react to form an organophylic clay, the quantity of organophylic being sufficient to stabilize the emulsion, generally two to five weight percent organophylic clay based on the weight of the oil-water mixture. The oil and water emulsion of this invention presents no volatility and no flash point problems. And in lieu of a clay and a dispersible amine, an organophylic clay can be used to stabilize the emulsion. This invention is also directed to a method for facilitating release of concrete from surfaces in contact therewith by coating such surfaces, prior to their contacting the concrete, with the vegetable based form release compositions as described herein.

In accordance with one embodiment, the pattern coating composition is prepared by blending a vegetable oil with a viscosity reducing additive. Examples of useful viscosity reducing additives include petroleum oils and alcohols. The viscosity reducing additives can be used alone or in combination to provide a composition having the desired viscosity, biodegradability, release properties and VOC level.

The present invention provides a biodegradable form release composition and a method for utilizing such a release composition to reduce adhesion between concrete and formwork and to prevent damage to the surface of concrete and the formwork.

Vegetable oils useful in the present invention are not particularly limited. In general, any vegetable oil may be used. Examples of vegetable oils useful in the present invention include, but are not limited to, corn oil, sesame oil, rapeseed oil, sunflower oil, palm oil, olive oil, coconut oil, peanut oil, soybean oil, canola oil. Corn oil is particularly useful.

The vegetable oil useful in the present invention may be refined or unrefined (crude). Refined oil refers to relatively pure oils in which all the fatty acids and non-oil materials have been removed by chemical means and physical or mechanical separation. Concrete form release compositions produced using unrefined vegetable oils are significantly less expensive than conventional form release compositions which require refined petroleum or vegetable oils as a base component.

The viscosity of corn oil is typically around 60–90 cps, typically 70 cps, whereas mineral seal oil used in prior art methods has a viscosity from about 7 to 27 cps. Therefore, it may be desirable to reduce the viscosity of the vegetable oil base by blending the oil with a viscosity decreasing additive. The viscosity of the vegetable oil base can be reduced by blending with a lower viscosity material, such as a petroleum oil, preferably a mineral seal oil, or an alcohol. Alcohols are particularly useful in reducing the viscosity of the vegetable oil. Alcohols also improve leveling of the coating thereby providing a smoother, more uniform surface. Typically, the coating composition of the present invention has a viscosity of between about 10 and 100 cps at 25° C. In more particular embodiments of the present invention, the viscosity of the coating composition is between about 15–50 cps. The viscosity of the coating composition can also extend beyond these ranges depending on the particular application method.

Useful alcohols include straight or branched chain alcohols having from 1 to 4 carbon atoms. Illustrative alcohols include methanol, ethanol, isopropanol, propanol, butanol, etc. Although methanol could be used as a viscosity reducer, it is not recommended because of its associated toxicity. Ethanol, particularly corn alcohol, is a particularly useful alcohol for reducing the viscosity of a corn oil.

The amount of alcohol used is the amount required to reduce the vegetable oil viscosity to the desired level. The amount of alcohol, when present, can range from about 0.5 to 10% by weight based on the total weight of the composition. Vegetable oils and alcohol are typically used at a ratio of 95 to 5, but can range from pure vegetable oil to about 90 parts vegetable oil and about 10 parts alcohol. Corn oil in combination with corn alcohol (ethanol) has been found to be particularly useful in providing a coating composition that exhibits the desired release properties and is very biodegradable.

The form coating composition of the present invention may also comprise a petroleum oil blended with the vegetable oil. A blend of petroleum oil and vegetable oil is advantageous in that the vegetable oil naturally contains fatty acids. Therefore, it is not necessary to separately add fatty acids during preparation of the form coating composition to obtain desired release properties. Blends prepared in accordance with this embodiment of the invention typically contain from about 10% to 90% petroleum oil based on the total weight of the composition.

Although fatty acids are not required to be added in the form release coating compositions, they can be added to enhance release properties. The fatty acids in accordance with the present invention are long chain fatty acids such as $C_{10}$–$C_{24}$ saturated, mono-unsaturated or di-unsaturated carboxylic acids which are liquids at room temperature. Preferred long chain fatty acids are mono-unsaturated $C_{16}$–$C_{20}$ carboxylic acids which are liquids at room temperature. Examples of useful fatty acids include, but are not limited to, palmitic acid, stearic acid, myristic acid, lauric acid, oleic acid, linoleic acid, and linolenic acid. A particularly useful fatty acid is oleic acid. The fatty acid portion of the formulation can range from 0 to 10% based on weight. Typical amounts of fatty acid will range from 1 to 3% by weight.

In accordance with another embodiment, the form release composition relates to an emulsified vegetable oil and various emulsifiers. Organophylic clays for years have provided viscosities and suspending properties required of drilling muds. The form release coating composition of certain embodiments of this invention borrows from this drilling mud art. Consequently, organophylic clays themselves are well known. They are prepared by treating a clay with an amine or an amine salt. Usually the clay-amine reaction is effected by mixing a clay dispersion with about 50 to 200 milliequivalents of amine per 100 grams of clay. Amines which can be incorporated in the emulsion, or which can be reacted with the clays to form organophylic emulsifying agents are high molecular weight straight chain and cyclic aliphatic amines. Desirable amines are those having six to twenty four carbon atoms in the alkyl chains, for example, hexyl amine, heptyl amine, decyl amine, undecyl amine, tridecyl amine, pentadecyl amine, heptadecyl amine, cetyl amine, and cyclic tertiary amines such as tall oil or cottonseed oil imidazolines as well as their salts.

The clays normally utilized in the preparation of organophylic clays and hence those preferred herein are those containing aluminum and magnesium atoms along with the silica which is characteristic of such clays. This includes such clays as bentonite, attapulgite, sepiolite and palygorskite, but excludes muscovite or mica and kaolinitic clays. Again, it will be appreciated that the organophylic clays can be prepared in situ. Thus, in addition to incorporating, say, octadecylammonium bentonite in a vegetable seal oil-water mixture, bentonite and octadecyl amine acetate can be included to the mixture to form the desired emulsion.

The concrete form release compositions of the present invention are applied to solid surfaces of the type in contact with fresh concrete such as forms, molds and the like by means such as brushing, rolling or spraying. For most large scale applications spraying is the most common method of application. In the case of porous surfaces, the surface typically will be sealed. Sealing may be accomplished by applying several coats of the compositions of the present invention.

The form release coating composition of the present invention is applied in an amount sufficient to provide the desired release properties from the form or mold. Typically, this will correspond to a coating thickness of from about 2 to about 10 mils. In accordance with particular embodiments of the present invention, the coating is applied at a coating thickness of from about 6 to 8 mils. Of course, additional material can be applied to provide the desired release.

The form release coating composition of the present invention is advantageous in that it is biodegradable. Vegetable oils and alcohols are highly degradable, particularly under aerobic conditions. Accordingly, the biodegradable form release compositions of the present invention are more environmentally friendly than the prior art petroleum hydrocarbon based compositions.

Having given the teachings of this invention, it will now be illustrated by means of specific examples.

EXAMPLE 1

An emulsion is prepared using corn oil and water to form following composition.

| MATERIAL | PARTS BY WEIGHT |
|---|---|
| Corn oil | 4000 |
| Water | 4000 |
| Amine* | 200 |
| Bentonite | 200 |

*1-hydroxyethyl-2-tall oil imidazoline

The above materials, when mixed in an ordinary mixer, produce a stable emulsion which is not affected by cold or hot temperatures. When frozen, the material returns to a stable emulsion after minor mixing. When used on the form face the product gives excellent results.

Even though a desirable, stable emulsion is formed by the procedure of Example 1, at times it will be desirable to incorporate certain additives in the composition. This is illustrated by the example which follows.

EXAMPLE 2

Following the procedure of Example 1 a form composition was made using the same materials plus additional ingredients to further improve the stability and application properties of the product. The ingredients were as follows:

| MATERIAL | PARTS BY WEIGHT |
|---|---|
| Corn oil | 4600 |
| Water | 4730 |

-continued

| MATERIAL | PARTS BY WEIGHT |
|---|---|
| Bentonite | 230 |
| Amine* | 230 |
| Isopropanol | 230 |
| Oleic acid | 100 |

*Amine = Octadecyl amine acetate

When used in an ordinary mixer, the foregoing ingredients produce a stable emulsion which is not affected by cold or hot temperatures. When frozen, the material returns to a stable emulsion after minor mixing when applied. The composition will wet the surface of the form with an improved efficiency.

EXAMPLE 3

Following Example 1 a form release coating composition was prepared using additional ingredients.

| MATERIAL | PARTS BY WEIGHT |
|---|---|
| Corn oil | 4550 |
| Water | 4550 |
| Diisopropanol | 230 |
| Hexamine | 340 |
| Attapulgite | 230 |
| Oleic acid | 100 |
| Isopropanol | 230 |

This composition has the advantage that it will require less mixing action in an ordinary mixer to form a stable emulsion.

EXAMPLE 4

Following Example 1 a form release coating was prepared using the following ingredients:

| MATERIAL | PARTS BY WEIGHT |
|---|---|
| Corn oil | 2000 |
| Water | 2000 |
| Isopropanol | 100 |
| Oleic acid | 50 |
| Organophylic clay* | 100 |

*Octadecylammonium bentonite

The foregoing materials when mixed in an ordinary mixer produce a stable emulsion which is not affected by cold or hot temperatures. When frozen, the material returns to a stable emulsion after minor mixing. When used on the form face the product gives excellent results, yielding surfaces which are extremely smooth.

EXAMPLE 5 (COMPARATIVE)

A presently manufactured product in the industry has the following composition:

| MATERIAL | PARTS BY WEIGHT |
|---|---|
| Mineral seal oil | 970 |
| Oleic acid | 30 |

This product was tested by a commercial testing laboratory and was found to have a Flash Point of 129° to 135° C. The parting composition of Example 3 when similarly tested did not have a flash point on heating to 100.degree. C., and at that point the water vapor extinguished the flame. As a form release coating composition the formula of Example 3 was superior to that of Example 5 because of the inclusion of the clay-amine compound.

EXAMPLE 6

A form coating in accordance with the present invention was prepared using the following ingredients:

| MATERIAL | PARTS BY WEIGHT |
|---|---|
| Corn oil | 4750 |
| Ethanol | 250 |

This composition has the advantage over comparative example 1 in that it will require less material for the application as a form release coating and has a higher flash point of greater than 300° F. In addition, this composition has the advantage that it does not require the addition of oleic acid and is biodegradable.

EXAMPLE 7

A form coating was prepared using the following ingredients:

| MATERIAL | PARTS BY WEIGHT |
|---|---|
| Corn oil | 3500 |
| Mineral seal oil | 1500 |

This composition has the advantage over example 5 that it will require less material for the application as a form coating. In addition, this composition has the advantage that it does not require the addition of oleic acid.

EXAMPLE 8

A form coating was prepared using the following ingredients:

| MATERIAL | PARTS BY WEIGHT |
|---|---|
| Corn oil | 2500 |
| Mineral seal oil | 2500 |

This composition has the advantage over example 7 that it has a lower viscosity and would result in easier application.

EXAMPLE 9

A form coating was prepared using the following ingredients:

| MATERIAL | PARTS BY WEIGHT |
|---|---|
| Corn oil | 2375 |
| Mineral seal oil | 2375 |
| Ethanol | 250 |

This composition has the advantage over example 8 that it has yet a lower viscosity and would result in easier application, but would have a lower flash point.

EXAMPLE 10

A form coating was prepared using the following ingredients:

| MATERIAL | PARTS BY WEIGHT |
|---|---|
| Corn oil | 1500 |
| Mineral seal oil | 3500 |

This composition has the advantage over examples 7, 8 and 9 that it has the lowest viscosity that would be preferred when simple spraying applications are employed. For example, this composition would be useful when applying the coating by hand wiping, alternative spray methods, or other methods presently used in the cement and/or concrete industry applications.

EXAMPLE 11

A particularly useful sand casting form release coating was prepared in accordance with the following:

| MATERIAL | PARTS BY WEIGHT |
|---|---|
| Corn oil | 48 |
| Petroleum oil | 48 |
| Alcohol | 2 |
| Fatty Acid | 2 |

The foregoing examples illustrate form release compositions which can be made in accordance with the present invention. When coatings of 100 mil to three-sixteenth inch thicknesses are applied to the forms adherence to the removed forms is so minimal that the resulting cavity is devoid of pits and deterioration. Traditionally, hydrocarbon systems have been used as form release materials for pattern faces. These compositions generally comprised hydrocarbon oil solvent along with organic additives such as oleic acid, waxes, paraffin, and the like. A composition consisting of vegetable oil and solvent in accordance with the present invention provides a biodegradable form release composition.

Form release coatings prepared in accordance with the present invention also provide improved emission characteristics as compared to petroleum based form release coatings. As indicated in Table 1, sand casting pattern compositions prepared in accordance with the present invention emit significantly less benzene per gram of release agent when tested in accordance with the emission test method for release agents established by the AFS (American Foundrymen's Society). Release agents having emission characteristics of less than 4 mg benzene per gram of release agent are an improvement over the prior art petroleum based sample.

TABLE 1

EMISSION CHARACTERISTICS OF FORM RELEASE COATINGS

| EXAMPLE | MATERIAL | mg BENZENE PER g OF RELEASE AGENT |
|---|---|---|
| 5 (Comparative) | Petroleum Based Liquid Parting | 4.25 |
| 6 | Vegetable Oil Base Liquid Parting | 2.61 |
| 9 | Blended Petroleum and Vegetable Oil Based Liquid Parting | 3.35 |
| 1 | Water Based Liquid Parting | 0.37 |

The form release coatings of the present invention also provide reduced VOC's as measured by EPA method 24 that are in compliance with the EPA limit for the concrete industry of below 3.8#/gallon, Furthermore, the form release coatings in accordance with the present invention are biodegradable whereas the petroleum based coatings of the prior art are not. Data relating to VOC and biodegradability are provided in Table 2 along with other characteristics of the form release coatings of the present invention (Examples 1, 6 and 9) compared to prior art petroleum based coatings (Example 5).

TABLE 2

CHARACTERISTICS OF FORM RELEASE COATINGS

| EXAMPLE | 5 (COMPARATIVE) | 6 | 9 | 1 |
|---|---|---|---|---|
| Physical Property | Petroleum Based Liquid Parting | Vegetable Oil Based Liquid Parting | Blended Petroleum and Vegetable Oil Based Liquid Parting | Water Based Liquid Parting |
| Flash Point in F Closed Cup | 275 | Greater than 200 | Greater than 250 | Water Vapor Ext. Flame |
| Viscosity (cps) | 10 | 47 | 15 | 167 |
| Specific Gravity | 0.8 | 0.9 | 1.86 | 0.9 |
| VOC (lbs/gal) Method 24 | 4.2 | 0.29 | 2.9 | 3.6 |
| Biodegradability | No | Yes | Yes | Not Determined |
| Biodegradability ½ life in days | 91 | 15–23 | 21 | Not Determined |

Various modifications are possible within the spirit of this invention as will be obvious to those skilled in the art. Such variations are deemed to be within the scope of this invention. In addition to ingredients illustrated, such additives as surfactants, either anionic, cationic or nonanionic and other emulsifying agents can be employed. It has already been emphasized that either the organophylic clay or the amine and the clay can be incorporated in the composition during the mixing stage.

What is claimed is:

1. In the process of protecting cement and/or concrete surfaces from pitting during production of a defined shape that has been determined by a form by preventing adherence, a form release coating composition is applied to the form surfaces in an amount sufficient to form a coating thereon which prevents adherence of material to the form, the improvement comprising applying to the form surfaces a form release coating composition consisting essentially of a from about 90% to 10% by weight vegetable oil, from about 10% to 90% by weight mineral seal oil, and optionally alcohol and/or a fatty acid.

2. The process of claim 1 wherein the vegetable oil is selected from the group consisting of corn oil, sesame oil, rapeseed oil, sunflower oil, palm oil, olive oil, coconut oil, peanut oil, soybean oil, canola oil and mixtures thereof.

3. The process of claim 2 wherein the vegetable oil comprises corn oil.

4. The method of claim 1 wherein said form release coating composition comprises approximately equal parts vegetable oil and mineral seal oil.

5. The method of claim 4 wherein said form release composition contains from 1 to 10% oleic acid.

6. The method of claim 5 wherein said vegetable oil comprises corn oil.

7. The method of claim 1 wherein said release coating composition has a viscosity of between about 10 and 100 cps at 25° C.

8. The method of claim 1 wherein said vegetable oil is an unrefined vegetable oil.

9. The method of claim 8 wherein said unrefined vegetable oil is unrefined corn oil.

10. The method of claim 1 wherein said form release coating composition contains from about 0.5% to 10% by weight alcohol.

11. The method of claim 10 wherein the alcohol is selected from the group consisting of ethanol, propanol, butanol, and mixtures thereof.

12. A method for facilitating release of concrete and/or cement from a form or mold surface comprising applying to the form or mold surface an effective amount of a biodegradable form release coating composition, wherein said biodegradable form release coating composition consists essentially of at least about 50% vegetable oil by weight; petroleum oil and optionally alcohol and/or a fatty acid.

13. The method of claim 12 wherein said form release coating composition has a volatile organic compound (VOC) content of less than 3.8 lbs/gal as measured by EPA method 24.

14. The method of claim 12 wherein the vegetable oil is selected from the group consisting of corn oil, sesame oil, rapeseed oil, sunflower oil, palm oil, alive oil, coconut oil, peanut oil, soybean oil, canola oil and mixtures thereof.

15. The method of claim 14 wherein the vegetable oil comprises corn oil.

16. The method of claim 12 wherein said release coating composition has a viscosity of between about 10 and 100 cps at 25° C.

17. The method of claim 12 wherein said vegetable oil is an unrefined vegetable oil.

18. The method of claim 17 wherein said unrefined vegetable oil is unrefined corn oil.

19. The method of claim 12 wherein said form release composition emits less than 4.0 mg benzene per gram of the composition.

20. The method of claim 12 wherein said form release coating composition contains from about 0.5% to 10% by weight alcohol.

21. The method of claim 20 wherein the alcohol is selected from the group consisting of ethanol, propanol, butanol, and mixtures thereof.

* * * * *